US010149502B2

(12) United States Patent
Scheid

(10) Patent No.: US 10,149,502 B2
(45) Date of Patent: Dec. 11, 2018

(54) HOODED JACKET HAVING ZIPPER

(71) Applicant: TURNABLE UG (HAFTUNGSBESCHRÄNKT), Neuwied (DE)

(72) Inventor: Bolko Boris Otto Scheid, Neuwied (DE)

(73) Assignee: TURNABLE UG (haftungsbeschränkt), Neuwied (DE)

( * ) Notice: Subject to any disclaimer, the term of this patent is extended or adjusted under 35 U.S.C. 154(b) by 0 days.

(21) Appl. No.: 14/917,953

(22) PCT Filed: Sep. 2, 2014

(86) PCT No.: PCT/DE2014/100315
§ 371 (c)(1),
(2) Date: May 31, 2016

(87) PCT Pub. No.: WO2015/035978
PCT Pub. Date: Mar. 19, 2015

(65) Prior Publication Data

US 2016/0309812 A1 Oct. 27, 2016

(30) Foreign Application Priority Data

Sep. 10, 2013 (DE) ..... 10 2013 109 888
Mar. 14, 2014 (DE) ..... 10 2014 103 519
Jun. 6, 2014 (DE) ..... 10 2014 108 043

(51) Int. Cl.
*A41D 15/00* (2006.01)
*A41D 3/00* (2006.01)
*A41D 27/10* (2006.01)

(52) U.S. Cl.
CPC ..... *A41D 15/005* (2013.01); *A41D 3/00* (2013.01); *A41D 15/00* (2013.01); *A41D 27/10* (2013.01);

(Continued)

(58) Field of Classification Search
CPC ..... A41D 15/00; A41D 15/005; A41D 3/00; A41D 27/10; A41D 2300/322
See application file for complete search history.

(56) References Cited

U.S. PATENT DOCUMENTS 646,194 A * 3/1900 Sims ..... A41D 13/1236 2/114
2,493,531 A * 1/1950 Fitches ..... A41D 15/00 2/115

(Continued)

FOREIGN PATENT DOCUMENTS

DE 89 04 516 U1 10/1989
DE 296 12 814 U1 9/1996

(Continued)

*Primary Examiner* — Richale Quinn
*Assistant Examiner* — Anne Kozak
(74) *Attorney, Agent, or Firm* — Gudrun E. Huckett

(57) ABSTRACT

A jacket (1) having a hood (4.1 and 4.2) which has a hood opening and having a zipper which begins at the lower end of the jacket front side (1.1 and 1.2) and which has two opposing strips (rows) (3.1 and 3.2) of zipper coupling members, which begin at the lower end in the two sections (I; II) along the coupling member rows (3.1 and 3.2) centrally in its longitudinal direction, and in that the strips (rows) (3.1 and 3.2) of zipper coupling members extend continuously and centrally over the entire jacket front side and jacket rear side along the edges of the hood (4.1; 4.2) bordering the hood opening up to the jacket rear side (2.1 and 2.2) and end at the lower end of the jacket rear side, and in that the strips (rows) (3.1; 3.2) are associated with another zipper slider (5).

8 Claims, 3 Drawing Sheets

(52) U.S. Cl.
CPC .... *A41D 2200/20* (2013.01); *A41D 2300/322* (2013.01)

(56) References Cited

U.S. PATENT DOCUMENTS

| | | | | | |
|---|---|---|---|---|---|
| 4,006,495 | A | * | 2/1977 | Jones | A41D 3/00 2/126 |
| 4,347,629 | A | * | 9/1982 | Itoi | A41D 3/00 2/108 |
| D279,937 | S | * | 8/1985 | Cohen | D2/717 |
| 4,574,397 | A | * | 3/1986 | Dennard | A41D 15/04 2/126 |
| 5,182,812 | A | * | 2/1993 | Goldsby | A61H 36/00 2/227 |
| 6,029,270 | A | * | 2/2000 | Ost | A41D 3/00 2/2.5 |
| 6,047,404 | A | * | 4/2000 | Blanks | A41D 15/00 2/108 |
| D580,633 | S | * | 11/2008 | Cross | D2/840 |
| D581,136 | S | * | 11/2008 | Cross | D2/840 |
| D637,377 | S | * | 5/2011 | Hertzen | D2/828 |
| D649,748 | S | * | 12/2011 | Maxwell, Sr. | D2/847 |
| D653,836 | S | * | 2/2012 | Woyshner | D2/750 |
| 8,272,072 | B1 | * | 9/2012 | Fowler | A41D 15/00 2/263 |
| D719,722 | S | * | 12/2014 | Bublak | D2/828 |
| D736,496 | S | * | 8/2015 | Gonzalez | D2/750 |
| 2009/0055991 | A1 | * | 3/2009 | Johnson | A41D 1/04 2/84 |
| 2010/0115684 | A1 | * | 5/2010 | Freedman | A41D 27/201 2/128 |
| 2014/0237700 | A1 | * | 8/2014 | Albert | A41D 15/04 2/84 |
| 2015/0052657 | A1 | * | 2/2015 | Miller | A41D 13/0015 2/67 |

FOREIGN PATENT DOCUMENTS

| | | | |
|---|---|---|---|
| DE | 20 2004 015 754 | U1 | 1/2005 |
| DE | 20 2011 001 224 | U1 | 6/2011 |
| GB | 2 192 529 | A | 1/1988 |
| WO | 2007/112614 | A1 | 10/2007 |

* cited by examiner

HOODED JACKET HAVING ZIPPER

BACKGROUND OF THE INVENTION

The invention concerns a jacket with a hood featuring a hood opening and with a zip fastener, which is beginning at the lower end of the front side of the jacket and comprises two rows of zip fastener connecting elements, opposing each other and beginning at the lower end of the front side of this jacket, and a zipper slider.

In DE 20 2004 015 754 U1 and DE 89 04 516 U1 jackets are described which have a zip fastener at their front side and at their back side, respectively, each zip fastener extending from the bottom of the jacket to the base of the neck or collar. The jacket which is described in DE 89 04 516.5 is equipped with removable and exchangeable sleeves, wherein the two-part front side and two-part back side of the jacket have different patterns. In these known jackets, the front side parts and the back side parts always remain as such unchanged and can only be combined to a second jacket with correspondingly tailored front side parts and back side parts.

These known jackets have no hood.

Known are so-called reversible jackets, equipped with zip fasteners, with different patterns at their inner side and outer side. The term "patterns" encompasses different designs, colorations, applications and the like. Such reversible jackets can be equipped also with removable sleeves that can be reattached to the jacket body and that also can have different patterns at their inner and outer sides.

It is the object of the invention to design a jacket with a hood featuring a hood opening and with a zip fastener beginning at the lower end of the front side of the jacket and comprising two opposed tapes (rows) of zip fastener connecting elements beginning at the lower end of the front side of the jacket as well as a zipper slider in such a way that its outer appearance can be expanded in such a way that the front sides and back sides when wearing the jacket are mutually interchangeable.

SUMMARY OF THE INVENTION

As a solution of this object, the jacket according to the invention is characterized in that it is divided centrally in its longitudinal direction along the zip fastener connecting element rows into two jacket segments and in that the tapes (rows) of zip fastener connecting elements extend continuously centrally substantially along the complete front and back sides of the jacket and along the borders delimiting the hood opening through the hood, divided in its longitudinal direction, to the back side of the jacket and end at the lower end of the back side of the jacket, and in that a further zipper slider is associated with the tapes (rows).

In this way, it is possible to interchange the front sides and the back sides of the jacket.

Preferred embodiments of the invention are described in dependent claims.

The separable two-way zip fasteners, preferably in head-to-head form, mentioned in connection with an embodiment of the invention in claim 5 are known.

BRIEF DESCRIPTION OF THE DRAWINGS

The invention will be described in the following with the aid of the drawing in more detail:

FIG. 1 shows a virtual view of a jacket with an open zip fastener wherein the jacket is separated centrally in its longitudinal direction along its front and back sides into two segments. The Figure shows the jacket in a virtual plan view; in reality, the front and back sides are connected to each other, as schematically shown by the dashed line a.

DESCRIPTION OF PREFERRED EMBODIMENTS

Figure 1:
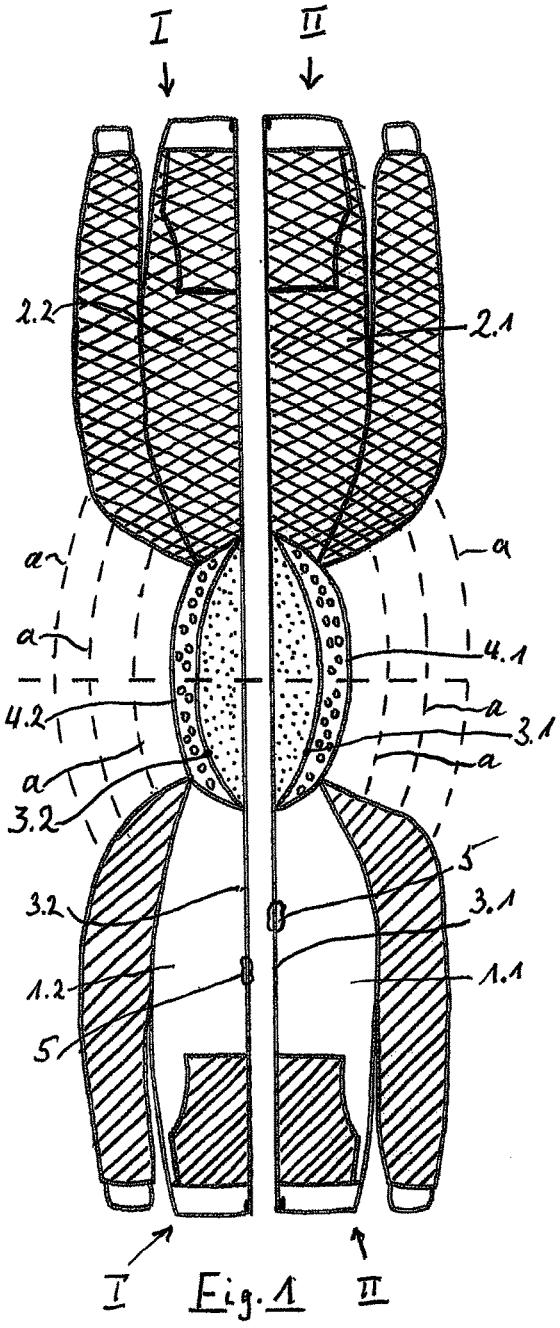

According to FIG. 1, the inventive jacket is separated centrally in its longitudinal direction along its front and back sides into two segments I and II, i.e., a segment I of the jacket shown to the left and a segment II of the jacket shown to the right. The front sides 1.1 and 1.2 of the jacket are connected to the back sides 2.1 and 2.2 of the jacket, as schematically shown by the dashed lines a.

At the facing edges of the two segments I and II of the jacket, tapes (rows) 3.1 and 3.2 are attached which are equipped with a plurality of zip fastener connecting elements (not shown in detail) and extend continuously over the entire front side and back side of the jacket, including the hood 4.1 and 4.2. These tapes (rows) 3.1 and 3.2 begin at the lower end of the front side 1.1 and 1.2 of the jacket and extend from there farther along the borders which are delimiting the hood opening through the hood 4.1 and 4.2, divided in its longitudinal direction, to the back side 2.1 and 2.2 of the jacket and end at the lower end of the back side 2.1 and 2.2. Preferably, two self-locking zipper sliders 5 are provided for joining the two segments I and II of the jacket to one jacket, as shown in FIG. 2.

The zip fastener used according to the invention is a so-called separable two-way zip fastener preferably of a head-to-head form.

In FIG. 1, the two rows of zip fastener connecting elements 3.1 and 3.2 are shown in their completely open state.

Figure 2:
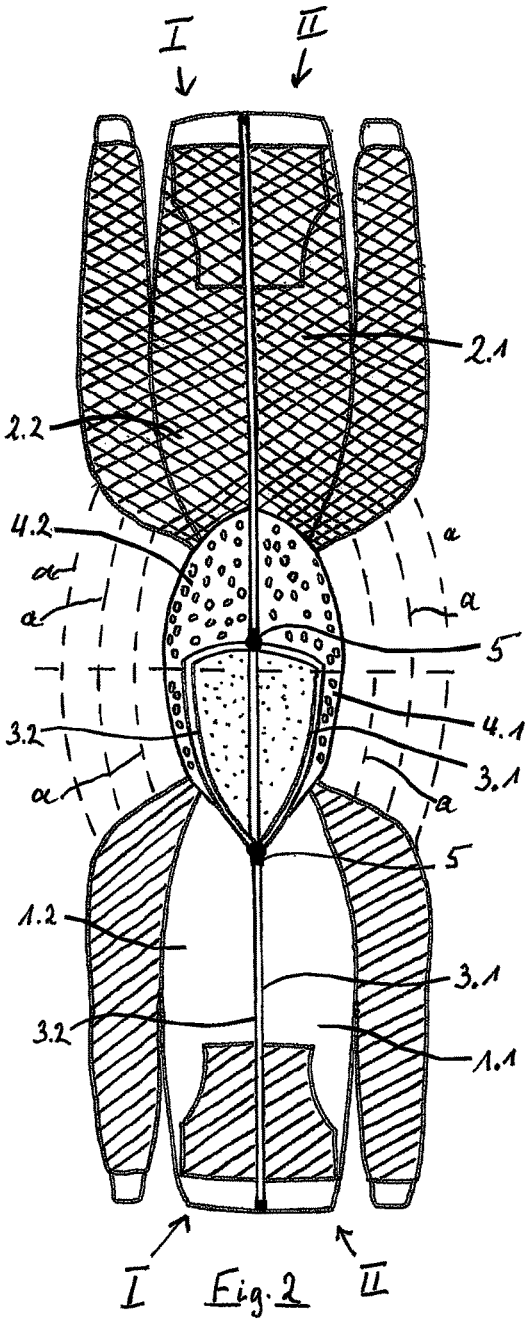
FIG. 2 shows, comparable with FIG. 1, the "folded-open" jacket in a presentation corresponding to the configuration of FIG. 3.

According to FIG. 2, the rows 3.1 and 3.2 of zip fastener connecting elements are partly or mainly closed by means of the two zipper sliders 5, wherein the first zipper slider 5 is pulled up approximately to the upper chest area while the part of the zip fastener which is adjoining the back side of the jacket is pulled up by means of the second zipper slider 5 approximately to the upper part of the hood 4.1 and 4.2 or to the forehead area of a person wearing the jacket.

Figure 3:
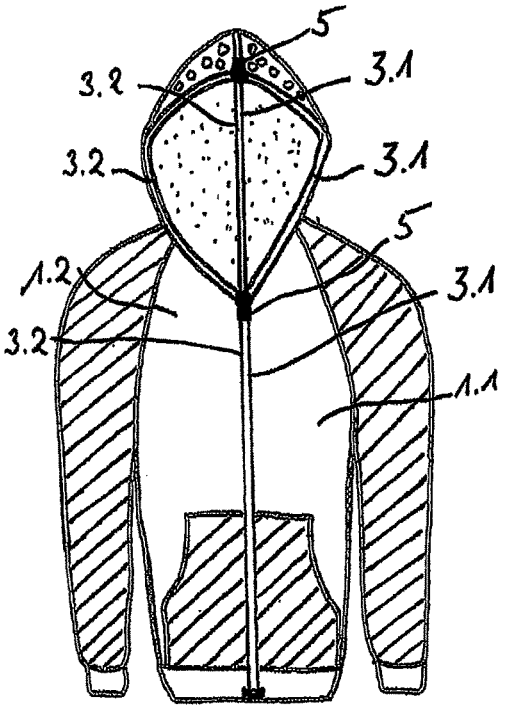
FIG. 3 shows the front view of the jacket according to the invention in a first state of use.

FIG. 3 shows a front view of the jacket according to the invention in a first state of use which corresponds to the virtually folded-open state of the jacket shown in FIG. 2.

Figure 5:
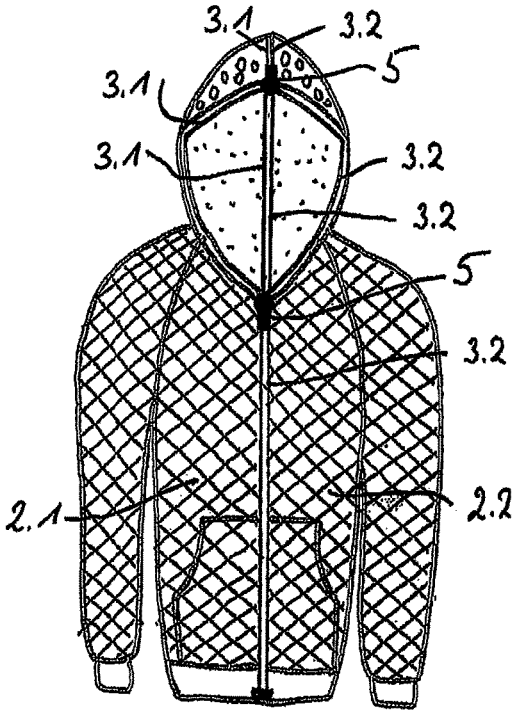
FIG. 5 shows the jacket in a second state of use in which the previous back side according to FIG. 4 is turned to become the front side.
Figure 4:
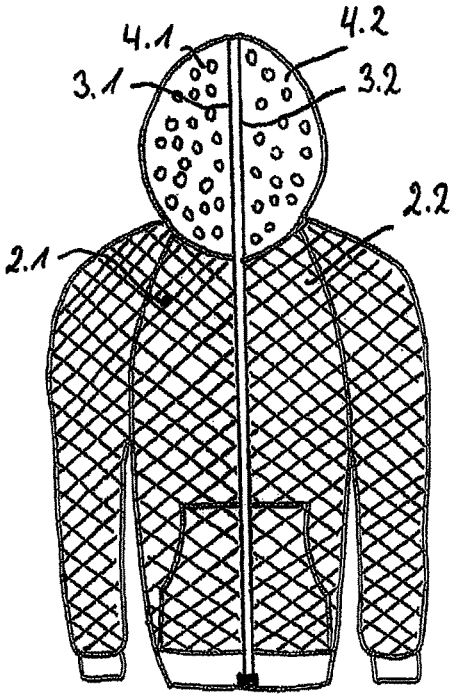
FIG. 4 shows the rear view of the jacket shown in FIG. 3.

FIG. 4 shows the back side of the jacket illustrated in FIG. 3,

FIG. 5 shows the jacket according to the invention in a second state of use in which the original back side 2.1 and 2.2 of the jacket according to FIG. 4 now forms the front side of the jacket.

Figure 6:
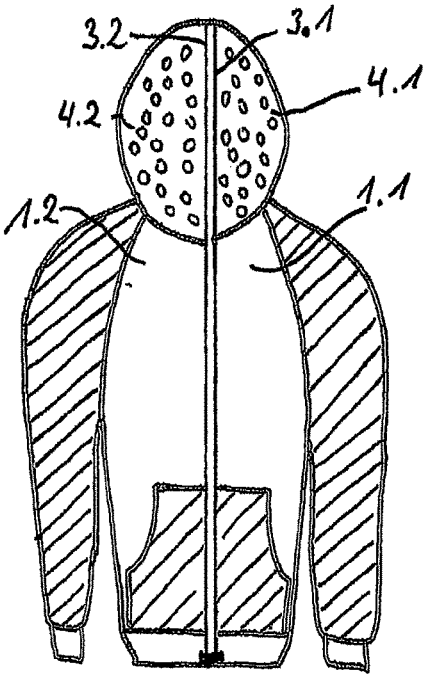
FIG. 6 shows the rear view of the jacket shown in FIG. 5.
Figure 7:
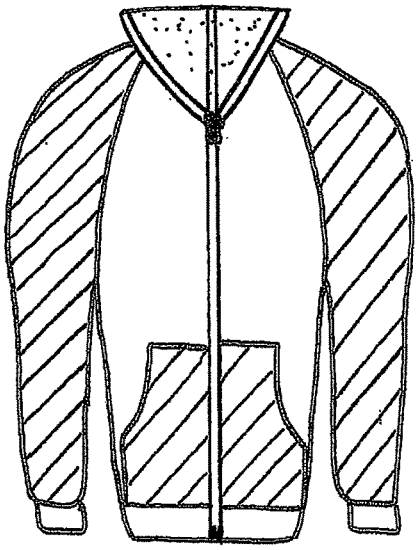
FIGS. 7-10 show, comparable with the FIGS. 3-6, the front and rear views of the jackets in their respective states of use, however in each case with folded-back hood.
Figure 8:
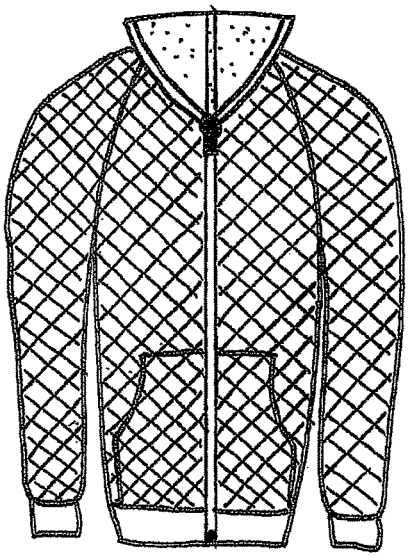
Figure 9:
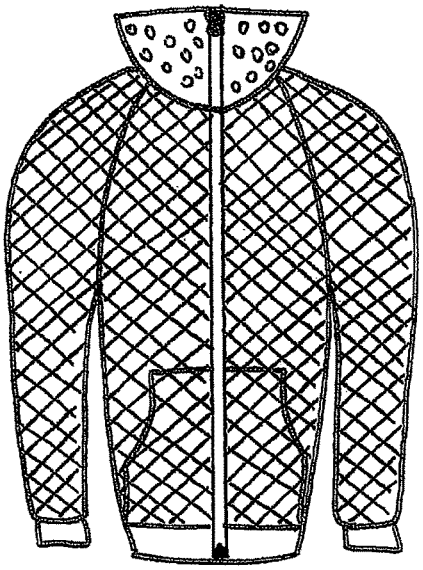
Figure 10:
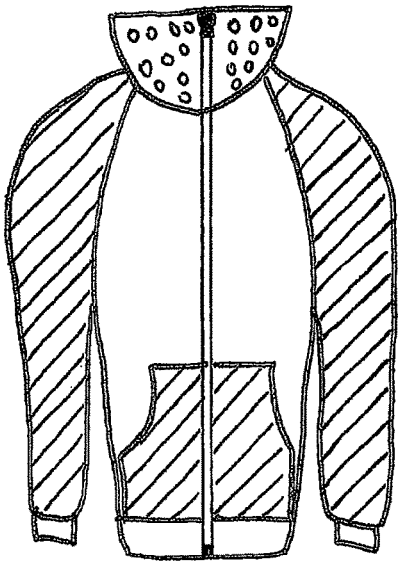

FIG. 6 shows the back side of the jacket illustrated in FIG. 5.

In FIGS. 2 to 10, the zip fastener is shown in a partly or mainly closed state, respectively.

The FIGS. 7 to 10 show, comparable to the FIGS. 3 to 6, the front and back sides of the jacket in their respective state of use, however with folded-back hood, respectively.

The jacket, as far as the material of the jacket is concerned, is divided into two symmetric segments I and II of the jacket. The front and back sides of the two segments I and II of the jacket have different patterns, namely preferably on their inner side as well as on their outer side. In this way, it is possible to wear the jacket in a multitude of states of use or combination possibilities. The first two states of use have already been described in detail. When the jacket according to the invention is now turned inside out, two additional states of use are available directly because these front sides and back sides of the jacket are interchangeable also. When the zip fastener is opened completely and the jacket is separated into its two segments I and II and only one of these two segments is turned inside out and joined again with the aid of the zip fastener, maximally four additional states of use result accordingly. When the reversible sleeves are taken into account too, several additional combination possibilities result because the sleeves are preferably also provided with different patterns on their inner side and outer side in the manner of reversible jackets. The jacket sleeves can be taken off preferably by zip fasteners, not shown, and reattached again.

The hood segments 4.1 and 4.2 are preferably formed as one piece together with the segments land II of the jacket.

The invention concerns also sleeveless jackets.

What is claimed is:

1. A jacket comprising:

a jacket body comprising a front side and a back side;

a hood attached to the jacket body and comprising a hood opening delimited by borders;

a single zip fastener consisting of two opposed tapes of zip fastener connecting elements and a first zipper slider and a second zipper slider;

wherein the two opposed tapes of zip fastener connecting elements extend centrally and continuously in a longitudinal direction of the jacket from a lower end of the front side along the complete front side, along the borders delimiting the hood opening, centrally along the hood in the longitudinal direction, along the complete back side to a lower end of the back side so that the jacket body is divided centrally in the longitudinal direction along the two opposed tapes of zip fastener connecting elements into two jacket segments and the hood is divided in the longitudinal direction along the two opposed tapes of zip fastener connecting elements into two hood segments.

2. The jacket according to claim 1, wherein the two jacket segments are symmetric in relation to the longitudinal direction along the two opposed tapes of zip fastener connecting elements.

3. The jacket according to claim 1, wherein the front side and the back side are patterned differently.

4. The jacket according to claim 1, wherein the single zip fastener is a separable two-way zip fastener.

5. The jacket according to claim 4, wherein the single zip fastener is a double slide zip fastener.

6. The jacket according to claim 1, wherein the first zipper slider is self-locking.

7. The jacket according to claim 6, wherein the second zipper slider is self-locking.

8. The jacket according to claim 1, wherein the two jacket segments each have one of the hood segments formed thereon or sewn on.

* * * * *